US008183973B2

(12) United States Patent
Ryu et al.

(10) Patent No.: US 8,183,973 B2
(45) Date of Patent: May 22, 2012

(54) HIGHLY DENSE AND NON-GRAINED SPINEL NTC THERMISTOR THICK FILM AND METHOD FOR PREPARING THE SAME

(75) Inventors: Jungho Ryu, Gyeongsangnam-do (KR); Dong-Soo Park, Seoul (KR)

(73) Assignee: Korea Institute of Machinery and Materials, Daejeon (KR)

( * ) Notice: Subject to any disclaimer, the term of this patent is extended or adjusted under 35 U.S.C. 154(b) by 270 days.

(21) Appl. No.: 12/759,278

(22) Filed: Apr. 13, 2010

(65) Prior Publication Data

US 2010/0259358 A1 Oct. 14, 2010

(30) Foreign Application Priority Data

Apr. 13, 2009 (KR) ..... 10-2009-0031828

(51) Int. Cl.
*H01C 7/10* (2006.01)

(52) U.S. Cl. ..... 338/22 SD; 338/22 R; 252/520.5; 29/610.1

(58) Field of Classification Search ..... 338/22 SD, 338/22 R; 252/62.3, 62, 520.5; 29/610.1
See application file for complete search history.

(56) References Cited

U.S. PATENT DOCUMENTS 6,143,207 A * 11/2000 Yamada et al. ..... 252/515
6,878,304 B2 * 4/2005 Ogata et al. ..... 252/62.3 R
7,422,784 B2 * 9/2008 Furukawa et al. ..... 428/116

FOREIGN PATENT DOCUMENTS

JP 05139706 A 6/1993
JP 10294204 A 11/1998
JP 2000348902 A 12/2000
JP 2005032996 A 2/2005
JP 2006032388 A 2/2006
JP 2008294326 A 12/2008

* cited by examiner

*Primary Examiner* — Kyung Lee
(74) *Attorney, Agent, or Firm* — Fredrikson & Byron, PA

(57) ABSTRACT

Disclosed herein are a highly dense and nano-grained NTC thermistor thick film and a method for preparing the same, and specifically, an NTC thermistor thick film vacuum deposited by spraying a spinel grained ceramic powder containing Ni and Mn on one side of the surface of a substrate using a room temperature powder spray in vacuum (AD) and a method for preparing the same. According to the present invention, a room temperature powder spray in vacuum (AD) may be used to perform a rapid deposition of NTC thermistor thick films and prepare a highly dense ceramic thick film, the NTC characteristic constant B which would be obtained by doping may be maximized without doping, demagnetization may be obtained without any additional heat treatment, and thus limitations on substrate that the conventional art has may be completely overcome.

15 Claims, 16 Drawing Sheets

HIGHLY DENSE AND NON-GRAINED SPINEL NTC THERMISTOR THICK FILM AND METHOD FOR PREPARING THE SAME

CROSS-REFERENCES TO RELATED APPLICATION

This patent application claims the benefit of priority from Korean Patent Application No. 10-2009-0031828, filed on Apr. 13, 2009, the contents of which are incorporated herein by reference.

BACKGROUND OF THE INVENTION

1. Field of the Invention

The present disclosure relates to a highly dense and nano-grained NTC thermistor thick film and a method for preparing the same.

2. Description of the Related Art

In general, the term "sensor" refers to a device which can respond to external stimuli or changes in the environment to enable appropriate reciprocal measures to be taken. Sensors may be varied and include, for example, temperature, pressure, gas, and infrared sensors. As the ranges of use for sensors become broader in various industries, the principles, kinds, and requirements of sensors are becoming more diverse and important.

A thermistor is a temperature sensor that changes in resistance according to a change in temperature. Thermistors include Negative Temperature Coefficient (NTC) thermistors and Positive Temperature Coefficient (PTC) thermistors. These are typical examples of electrically conductive ceramics.

An NTC thermistor is one that operates on the principle of its resistance decreasing as the temperature increases. Most thermistors fall into the NTC category, which has the characteristic semiconductor property of resistance exponentially decreasing over a wide temperature range.

A PTC thermistor is a special thermistor that operates on the principle of its resistance drastically increasing when the temperature surpasses a critical level, which is due to changes in dielectric characteristics that affect electrical properties which may bring about a big change in resistance even in a very narrow temperature range in regions between particles.

Referring to the related art of thermistors, studies had been conducted on materials and compositions of thermistors in the UK and USA from the late 1930s to the early 1940s, and oxides of the transition metals Mn, Ni, Co, Fe, Cu, etc. were used as raw materials to develop composite oxide products made of two or more oxides. In addition, a Mn—Ni oxide-based composite sintered body was developed at Bell Laboratories in the US in 1946, named "thermistor", and commercialized. Then, at the turn of the 1950s, the thermistor began to draw attention as a temperature sensor due to development in the tricomponent system of Mn—Co—Ni oxides and later materials containing Fe—Cu oxides and rapid advancement in manufacturing technology.

The thermistor may be classified into disc, diode, chip (epoxy and glass) types using conventional ceramic manufacturing technology; surface-mounted types using thick film or thick film stacking processes; and thin film types. Because the thermistor is inexpensive and has a high rate of resistance variation, it is easy to manufacture as a sensor by which temperature may be precisely controlled and managed. Relatively high resistance values may also be obtained at room temperature.

Because thermistor materials having an $NiMn_2O_4$-based spinel grain structure, which are widely used in Negative Temperature Coefficient (NTC) thermistors, are required in the application of film-type thermistors including thick and thin film type thermistors, methods of forming thick films using a screen printing method for sintering are commonly used. The method is a low-cost, stabilized process for industrial use and suitable for mass-production. However, materials have poor sintering properties and must be subjected to a heat treatment (sintering process) at high temperatures. Because the materials also contain a large amount of organic additives during screen printing, the sintering density of the materials after sintering is not as high as expected. Due to a high temperature (900° C. or higher) sintering which is an essential process of screen printing, there is a limitation in available substrates. In the case of a substrate such as glass or polymer which is modified or melted at high temperatures, or a substrate using materials which easily inter-diffuse into NTC compositions at high temperature, it is impossible to prepare an NTC thermistor film with a preparation method using screen printing.

Although several attempts to prepare highly dense thermistor thin and thick films using electron-beam evaporation, pulsed laser deposition, RF reactive sputtering, etc. have been made in order to overcome these problems, these methods require high-vacuum devices and have many difficulties in commercialization due to low deposition rates in the range of a few nanometers per minute.

Thus, the present inventors have studied methods for preparing highly dense thick film, by which thick films may be deposited at room temperature without high temperature sintering processes, confirmed that a room temperature powder spray in vacuum (so called Aerosol-Deposition; AD) may be used for rapid deposition, and that highly dense and nano-grained thick films may be prepared without additional heat treatment processes, and completed the present invention.

SUMMARY OF THE INVENTION

In an embodiment, the present invention provides a highly dense and nano-grained spinel $NiMn_2O_4$-based negative temperature coefficient thermistor thick film.

In another embodiment, an NTC thermistor thick film is provided that is vacuum deposited by spraying a spinel grained ceramic powder containing Ni and Mn on one side of the surface of a substrate using a room temperature powder spray in vacuum.

In a further embodiment, a NTC thermistor thick film is provided. The thick film of this embodiment comprises a vacuum spray-deposited spinel grained ceramic powder. The powder is comprised of Ni and Mn. The thick film is deposited on one side of the surface of a substrate or on one surface of a substrate using a room temperature powder spray in vacuum.

In another embodiment, the present invention provides a method for preparing a highly dense and nano-grained spinel $NiMn_2O_4$-based negative temperature coefficient thermistor thick film.

In another embodiment of a method of the invention, the method for preparing an NTC thermistor thick film using a powder spray in vacuum, comprises the steps of: placing a ceramic powder C into a mixing vessel to fix a substrate on a stage as a material preparation step S100; supplying a carrier gas into the mixing vessel to mix the ceramic powder C with the carrier gas as a gas supply step S200; feeding the carrier gas and ceramic powder C mixed in the mixing vessel to spray them on the substrate as a particle spray step S300; and transferring the stage to form the NTC thermistor thick film 220 as a thick film formation step 240.

In yet another embodiment of a method of the invention, the method for preparing an NTC thermistor thick film, comprises the steps of: preparing a ceramic powder C into a mixing vessel for deposition onto a surface of a substrate; supplying a carrier gas into the mixing vessel to mix the ceramic powder C with the carrier gas and form a gas-powder mix; spraying the gas-powder onto as surface of the substrate to form the NTC thermistor thick film 220.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Features and advantages of the present invention will be more clearly understood by the following detailed description of the present preferred embodiments by reference to the accompanying drawings. It is first noted that terms or words used herein should be construed as meanings or concepts corresponding with the technical sprit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

Hereinafter, the present invention will be described in detail.

The present invention provides an NTC thermistor thick film vacuum deposited by spraying a spinel grained ceramic powder containing Ni and Mn on one side of the surface of a substrate using a room temperature powder spray in vacuum (AD).

The NTC thermistor thick film is anchored on the external surface of the substrate to provide adhesion.

The NTC thermistor thick film has a thickness of about 0.2 μm to about 50 μm.

The NTC thermistor thick film has a density of 95% or more.

The NTC thermistor thick film has a nano-grained microstructure.

The NTC thermistor thick film has an NTC characteristic constant B of 3000 K or more.

The NTC thermistor thick film is anchored on the external surface of the substrate and then not subjected to a heat treatment process.

The ceramic powder is formed of an oxide material having a spinel grain structure which contains Ni and Mn elements ($NiMn_2O_4$, $NiMn_2O_4$ doped with Co, $NiMn_2O_4$ doped with Fe, and $NiMn_2O_4$ doped with Cu).

The ceramic powder has various compositions of Ni and Mn to allow for fine regulation.

The ceramic powder has a particle size distribution of about 0.5 μm to about 10 μm.

The substrate is formed of an electric insulator such as glass, ceramic, etc.

The NTC thermistor thick film has a film formation rate of 0.1 μm/round or more.

Hereinafter, the configuration of an NTC thermistor thick film forming device for preparation of the NTC thermistor thick film will be described with reference to FIGS. 1 and 2 attached.

Figure 1:
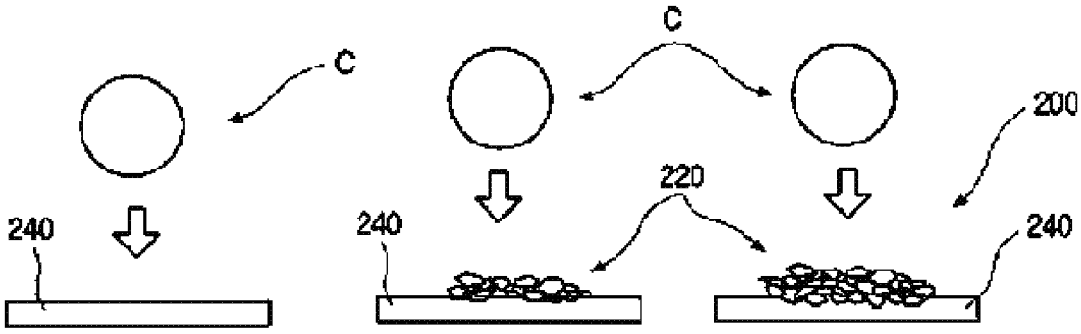
FIG. 1 is a conceptual view illustrating the deposition principle of a $NiMn_2O_4$-based NTC thermistor thick film according to the present invention.
Figure 2:
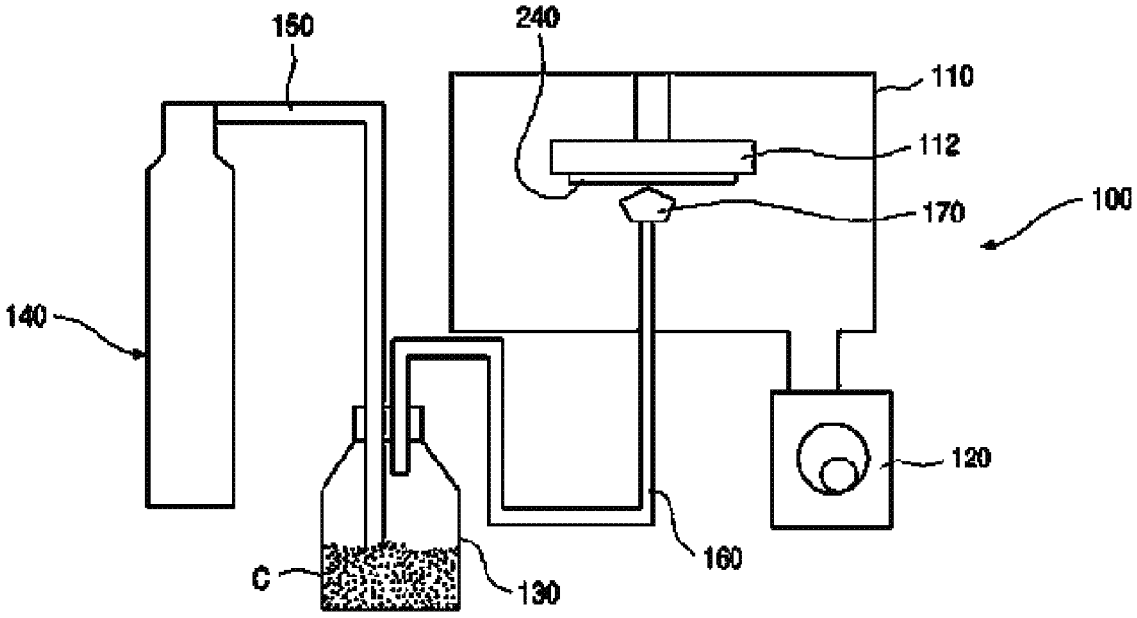
FIG. 2 is a schematic view illustrating the configuration of an NTC thermistor thick film forming device for preparing a $NiMn_2O_4$-based NTC thermistor thick film according to the present invention.

FIG. 1 is a conceptual view illustrating the deposition principle of an NTC thermistor thick film according to the present invention, and FIG. 2 is a schematic view illustrating the configuration of an NTC thermistor thick film forming device for preparing an NTC thermistor thick film according to the present invention.

The NTC thermistor thick film forming device 100 as shown in the figures is a device to spray and anchor a ceramic powder C on an electrically insulating substrate 240 by using a room temperature powder spray in vacuum to form an NTC thermistor thick film 220.

Specifically, the NTC thermistor thick film forming device 100 includes a vacuum chamber 110 including a moving stage 112 which supports a substrate 240, a vacuum pump 120 connected through a pipe to the vacuum chamber 110 to provide a vacuum inside the vacuum chamber 110, a mixing vessel 130 in which a ceramic powder C is received, a gas supply means 140 through which a carrier gas is stored and sprayed, a gas supply pipe 150 through which the gas supply means 140 is connected to the mixing vessel 130 to introduce the carrier gas into the mixing vessel 130, a feed pipe 160 to introduce the ceramic powder C mixed with the carrier gas into the vacuum chamber 110, and a nozzle 170 provided on one end of the feed pipe 160 and through which the ceramic powder C passing through the feed pipe 160 is sprayed on the substrate 240.

The stage 112 fixes a substrate 240 on the undersurface, is provided to move in the three axial directions, and moves at a rate of about 0.1 to about 10 mm/sec. When a ceramic powder C is sprayed from under the substrate 240, the ceramic powder C is anchored on the undersurface of the substrate 240 to form an NTC thermistor thick film 220.

The vacuum chamber 110 forms a closed space and is connected through a pipe to the vacuum pump 120 to create a vacuum state when the vacuum pump 120 is operated such that the degree of vacuum of the vacuum chamber 110 may be about 1 Torr or less.

A nozzle 170 is provided at a position downward separated from the stage 112. The nozzle 170 is fixed at a certain position inside the vacuum chamber 110 to guide the spraying direction of a ceramic powder C.

Thus, when the ceramic powder C is upwardly sprayed through the nozzle 170 and the substrate 240 is moved by the movement of the stage 112, an NTC thermistor thick film 220 may be formed to various shapes on the undersurface of the substrate 240 by the moving direction of the stage 112.

The upper end of the nozzle 170 is downward separated from the substrate 240 by a distance of about 1 mm to about 40 mm, and is separated from the substrate 240 by a distance of about 5 mm in embodiments of the present invention.

Furthermore, the width of the nozzle 170 is about 0.1 mm to about 2.0 mm and the length of the nozzle 170 is about 5 mm to about 300 mm. The cross-sectional shape, width, and length of the nozzle 170 may be variously changed according to ingredients in the ceramic powder C and the deposition thickness of the NTC thermistor thick film 220.

The nozzle 170 is connected to a feed pipe 160. The feed pipe 160 introduces the ceramic powder C in a mixing vessel 130 with a carrier gas into the nozzle 170, and both ends of the feed pipe 160 are connected to the mixing vessel 130 and the nozzle 170, respectively.

More specifically, the upper end of the feed pipe 160 in the right is connected to the nozzle 170 while the lower end in the left is fixed to be positioned at the upper portion inside the mixing vessel 130 such that the end does not contact the ceramic powder C.

The mixing vessel 130 is supplied with a carrier gas by a gas supply pipe 150, sprays the ceramic powder C therein included, and simultaneously introduces the ceramic powder C and the carrier gas into the feed pipe 160.

Thus, a gas supply pipe 150 is positioned in the left side in the mixing vessel 130 and the lower end of the gas supply pipe 150 is connected to the ceramic powder C included in the mixing vessel 130. The shape and structure of the mixing vessel 130 may be variously changed according to the configuration of the equipment.

Furthermore, the ceramic powder C includes a spinel grained ceramic powder containing Ni and Mn. More specifically, the ceramic powder C may be selected from the group consisting of $NiMn_2O_4$, $NiMn_2O_4$ doped with Co, $NiMn_2O_4$ doped with Fe, and $NiMn_2O_4$ doped with Cu.

In the gas supply means 140, a carrier gas which is introduced into the mixing vessel 130 by a gas supply pipe 150 sprays a ceramic powder C, and the sprayed ceramic powder C is guided through a feed pipe 160 which is the only exit into the nozzle 170.

A carrier gas is supplied into and stored in the gas supply means 140. The carrier gas may include air, oxygen ($O_2$), nitrogen ($N_2$), helium (He), Argon (Ar), etc. Because the formation of an NTC thermistor thick film 220 on a substrate 240 is not much influenced according to the kind of carrier gas, a low-priced gas may be preferably used.

The input flow rate of carrier gas which may be introduced from the gas supply means 140 into the mixing vessel 130 may be controlled within the range of 1 l/min or more. However, the input flow rate may be modified according to the size of a nozzle 170.

Hereinafter, a method for preparing an NTC thermistor thick film 220 using an NTC thermistor thick film forming device configured as above will be described with reference to FIG. 3 attached.

Figure 3:
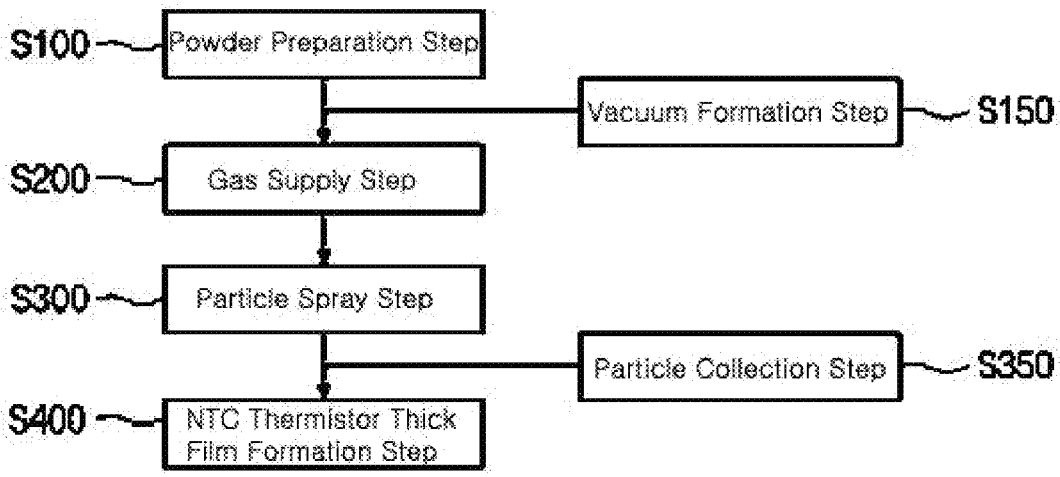
FIG. 3 is a flowchart illustrating a method for preparing a $NiMn_2O_4$-based NTC thermistor thick film according to the present invention.

FIG. 3 is a flowchart illustrating a method for preparing an NTC thermistor thick film according to the present invention.

As illustrated in the figure, an NTC thermistor thick film 220 according to the present invention is prepared by a method including: placing a ceramic powder C into a mixing vessel 130 to fix a substrate 240 on a stage 112 as a powder preparation step S100, supplying a carrier gas into the mixing vessel 130 to mix the ceramic powder C with the carrier gas as a gas supply step S200, feeding the carrier gas and ceramic powder C mixed in the mixing vessel 130 to spray them on the substrate 240 as a particle spray step S300, and transferring the stage 112 to form the NTC thermistor thick film 220 as a thick film formation step 240.

Figure 9:
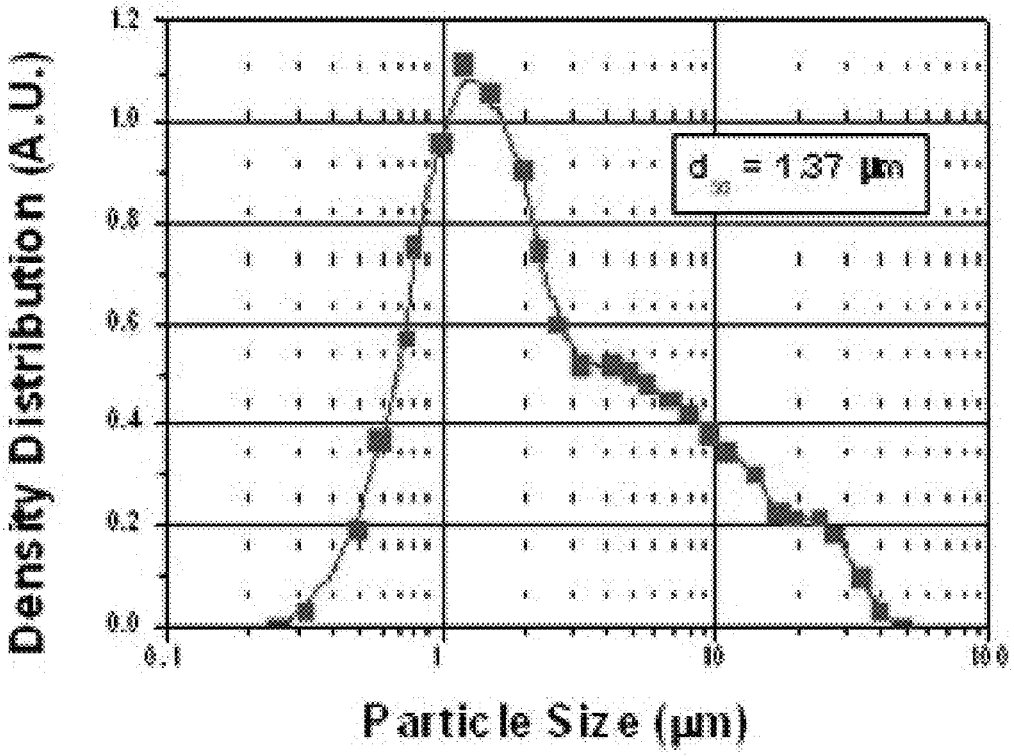
FIG. 9 is a graph illustrating the measurement of particle size distribution of powder with which an NTC thermistor thick film is prepared according to one embodiment of the present invention.

In the powder preparation step S100 of the present invention, the ceramic powder C is a spinel grained ceramic powder containing Ni and Mn and may be selected from the group consisting of $NiMn_2O_4$, $NiMn_2O_4$ doped with Co, $NiMn_2O_4$ doped with Fe, and $NiMn_2O_4$ doped with Cu. What is commercially available may be used as the ceramic material, or NiO and $Mn_2O_3$ may be ground, mixed, and subjected to calcination at 850° C. or higher, followed by pulverization suitable for powder spray coating at room temperature using ball mill or planetary mill. The composition of Ni and Mn may be variously changed to control the contents of the elements by modifying the mixing ratio of NiO and $Mn_2O_3$ in the ceramic powder. Preferably, the ceramic powder may have a particle distribution of about 0.5 μm to about 10 μm as illustrated in FIG. 9.

When the powder preparation step S100 is completed, the mixing vessel 130 is filled with the ceramic powder C and a substrate 240 is fixed on the undersurface of the stage 112. Subsequently, the gas supply step S200 is performed.

The gas supply step S200 is a process in which a carrier gas stored in a gas supply means 140 is supplied through a gas supply pipe 150 into the mixing vessel 130 to mix the ceramic powder C with the carrier gas.

Because the flow rate of the carrier gas which is introduced into the mixing vessel 130 from the gas supply means 140 is controlled over 1 l/min, the ceramic powder C in the mixing vessel 130 is sprayed by introduction of the carrier gas.

A vacuum formation step S150 is performed between the powder preparation step S100 and the gas supply step S200. The vacuum formation step S150 is a step in which a vacuum pump 120 is operated to set the inside of the vacuum chamber 110 to 1 torr or less. Thus, the carrier gas which has been mixed with the ceramic powder C and introduced through the mixing vessel into the inside of the vacuum chamber 110 may be sucked into the vacuum pump 120.

After the gas supply step S200, a particle spray step S300 is performed. The particle spray step S300 is a step in which a ceramic powder C is sprayed through a nozzle 170 on the undersurface of a substrate 240. The carrier gas and ceramic powder C mixed in the mixing vessel 130 is sequentially passing through a feed pipe 160 and a nozzle 170 and sprayed upwardly from the nozzle 170 such that the ceramic powder C is anchored and vacuum deposited on the undersurface of the substrate 240. During the particle spray step S300, the inside of the mixing vessel 130, feed pipe 160, and vacuum chamber 110 is maintained at about 1 Torr to about 20 Torr and the degree of vacuum may be varied according to the flow rate of the carrier gas. Preferably, the film deposition rate may be 0.1 μm/round or more.

After the particle spray step S300, a particle collection step S350 to collect a ceramic powder C sprayed into a vacuum chamber 110 without deposition on the substrate 240 is performed. The ceramic powder C collected in the particle collection step S350 is again collected for recycling. Although it is not shown in FIG. 2, a separate filtering means may be provided between the vacuum pump 120 and the vacuum chamber 110 to selectively filter the ceramic powder C only.

On the external surface of the substrate 240, an NTC thermistor thick film formation step S400 to form an NTC thermistor thick film 220 as the thickness of the deposited ceramic powder C increases is performed. During the NTC thermistor thick film formation step S400, an NTC thermistor thick film 220 with a thickness of about 0.2 μm to about 50 μm is formed. The thickness of the NTC thermistor thick film 220 may be controlled according to the time for which the particle spray step S330 is performed.

Preferably, the density of the NTC thermistor thick film 220 may be 95% or more.

Preferably, the particle collection step S350 may be continuously performed while the ceramic powder C may be sprayed.

According to the configuration, a uniform and highly dense NTC thermistor thick film may be formed, applied to various substrates without heat treatment processes, and deposited at a high speed. Therefore, it is advantageous in that the durability and productivity may be enhanced.

Hereinafter, the present invention will be described in more detail with reference to preferred embodiments. However, the following embodiments are provided for illustrative purposes only, and the scope of the present invention should not be limited thereto in any manner.

<Embodiment>Preparation of $NiMn_2O_4$-Based NTC Thermistor Thick Film

In order to prepare an $NiMn_2O_4$ powder as the ceramic powder C, reagent-grade $Mn_2O_3$ (99.9%, Sigma Aldrich Co.) and NiO (99.9%, Kojundo Chem. Co., Japan) were used. Ethanol was added into a mixed powder of the $Mn_2O_3$ and NiO and 3Y-TZP (yttria stabilized zirconia) ball media were used to perform a ball milling for 24 hours for pulverization/mixture. The pulverized and mixed powder was dried and subjected to calcination at about 850° C. for about 10 hours to form a $NiMn_2O_4$ spinel powder. Because the calcined powder was firmly aggregated, ball mill or planetary mill was used to pulverize the powder for about 10 hours. As a result, a powder with an average diameter ($d_{50}$) of about 1.4 μm was obtained.

Subsequently, the $NiMn_2O_4$ spinel powder is placed into a mixing vessel in an NTC thermistor thick film forming device, a glass substrate was fixed on the stage, and then the powder is sprayed five times on the glass substrate at room temperature at an air flow rate of 10 l/min to prepare an NTC thick film which is 5 μm thick.

<Characteristic Analysis>

(1) X-Ray Diffraction Analysis

In order to confirm the crystallinity of a prepared powder, an x-ray diffraction analyzer (XRD: D-MAX 2200, Rigaku Co., Tokyo, Japan) was used and the confirmation of the crystallinities of an NTC thermistor film and a film which was subjected to a heat treatment was also performed.

Figure 4:
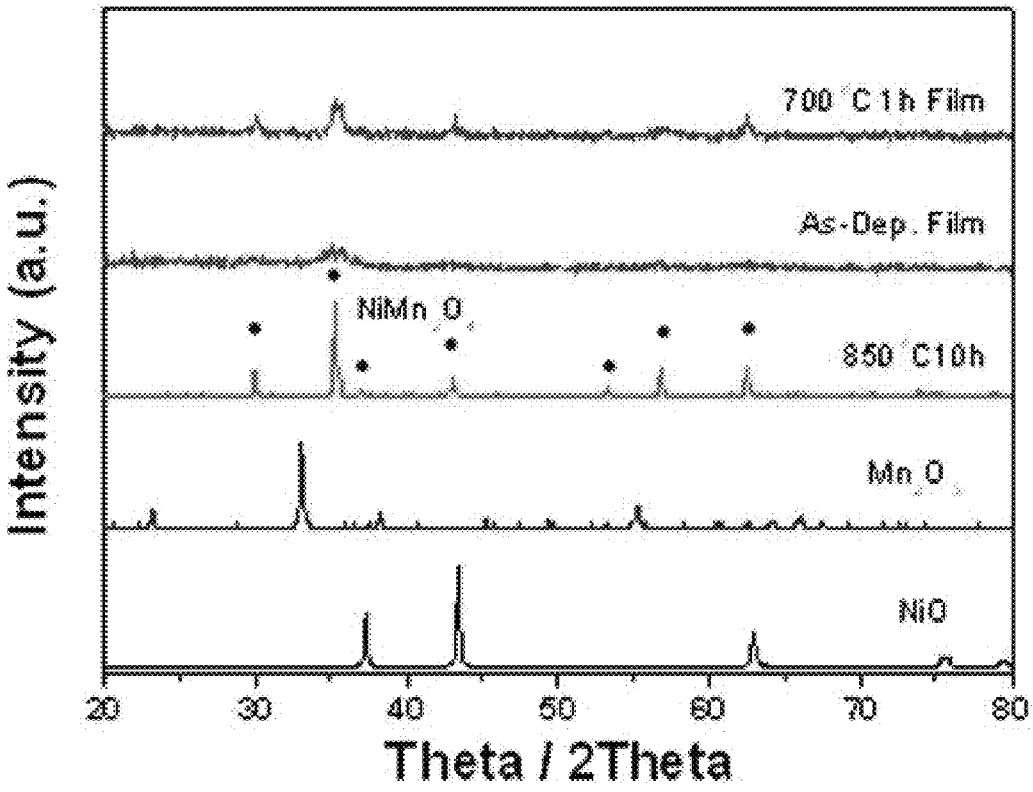
FIG. 4 is a graph illustrating XRD patterns of a $NiMn_2O_4$-based NTC thermistor thick film according prepared to one embodiment of the present invention.

The measurement results were illustrated in FIG. 4.

In FIG. 4, the XRD patterns are illustrated from the bottom to the top: an NiO material powder, an $Mn_2O_3$ material powder, an $NiMn_2O_3$ powder synthesized by calcination at 850° C. for 10 hours, an NTC thermistor thick as deposited, and the deposited NTC thermistor thick film which had been subjected to a heat treatment at 700° C. for 1 hour.

As illustrated in FIG. 4, it may be confirmed that a pure $NiMn_2O_4$ spinel phase without any secondary phase was formed when a mixed powder was subjected to calcination at 850° C. for 10 hours. It may be confirmed that a main peak in the XRD peaks of a pure $NiMn_2O_4$ was observed at a low value, and it was also confirmed that peaks were observed at high values when films were subjected to a heat treatment at 700° C. This indicates that a deposited NTC thermistor film was pulverized into nano grain particles or a non-crystalline phase for deposition by a strong mechanical shock during a powder spray process at room temperature, meaning that grain particle growth and amorphous crystallization were realized.

(2) Microstructure Observation by Scanning Electron Microscopy

The cross-section of an NTC thermistor thick film prepared was observed by scanning electron microscopy (SEM: JSM-5800, JEOL CO., Tokyo, Japan) and the cross-section of a film which had been subjected to a heat treatment was also observed in the same manner.

Figure 5:
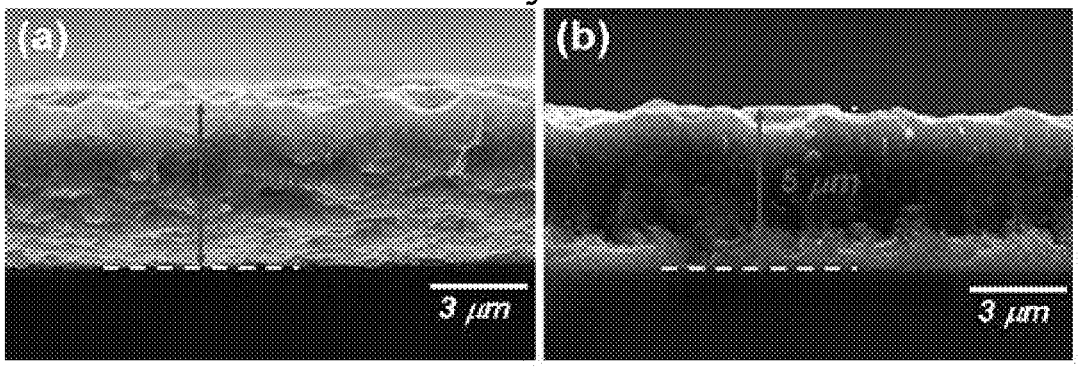
FIG. 5 is a set of SEM photos of an NTC thermistor thick film prepared according to one embodiment of the present invention ((a) a microstructure of an NTC thermistor thick film prepared and (b) a microstructure of the NTC thermistor thick film which had been subjected to a heat treatment at 700° C.)

The measurement results are illustrated in FIG. 5.

In FIG. 5, (a) is a photo by scanning electron microscopy, illustrating the cross-section of an NTC thermistor thick film prepared and (b) is a photo by scanning electron microscopy, illustrating the cross-section of a thick film by subjecting the NTC thermistor thick film to a heat treatment at 700° C.

As illustrated in FIG. 5 (*a*), it may be understood that a highly dense film which was 5 μm thick had been formed from the prepared NTC thermistor film. As illustrated in FIG. 5 (*b*), it may be understood that the film had been safely attached to the substrate without lamination with the substrate, pore formation, and crack even after a heat treatment.

(3) Microstructure Observation by Transmission Electron Microscopy

The microstructures of an NTC thermistor thick film prepared and a film which had been subjected to a heat treatment were observed by transmission electron microscopy (TEM: JEM-2100F, JEOL CO., Tokyo, Japan).

Figure 6:
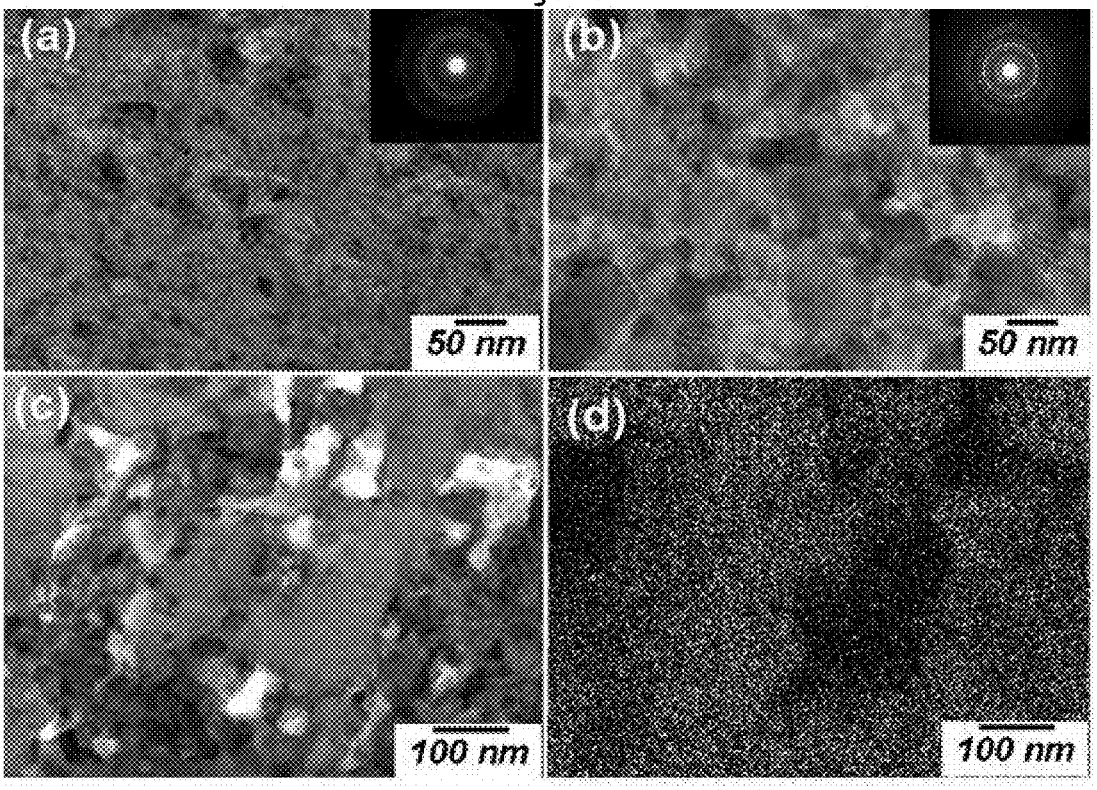
FIG. 6 is a set of TEM photos of an NTC thermistor thick film prepared according to one embodiment of the present invention ((a) a microstructure of an NTC thermistor thick film prepared, (b) a microstructure of the NTC thermistor thick film which had been subjected to a heat treatment at 700° C., (c) an abnormal microstructure of the NTC thermistor thick film which had been subjected to a heat treatment at 700° C., (d) an EDX 2-D Ni elemental analysis map, and the inside views in (a) and (b) illustrate selected area electron diffraction (SAED) patterns)

The measurement results are illustrated in FIG. 6.

In FIG. 6, (a) illustrates a microstructure of an NTC thermistor thick film prepared, (b) illustrates a microstructure of the NTC thermistor thick film which had been subjected to a heat treatment at 700° C., (c) illustrates an abnormal microstructure of the NTC thermistor thick film which had been subjected to a heat treatment at 700° C., and (d) illustrates an EDX 2-D Ni elemental analysis map. The inside views in (a) and (b) illustrate selected area electron diffraction (SAED) patterns.

As illustrated in FIG. 6, it may be understood that a microstructure of the NTC thermistor thick film after deposition (a) was formed of several nanometer-sized micro grained particles and of several tens nanometer-sized micro grained particles as a result of growth of micro grained particles when a heat treatment was performed at 700° C. However, as illustrated in FIG. 6 (*c*), it was confirmed that an abnormal grained particle growth was observed at some regions of a thick film after a heat treatment, and the abnormal grained particles were identified as the ones which had an insufficient Ni content. In other words, a heat treatment at 700° C. or higher is not preferred because it may change the grained phase of the NTC thermistor thick film according to the present invention.

Specifically, an $Ni^{2+}$ ion was added into an octahedral vacant site in the spinel structure of an $NiMn_2O_4$-based NTC material to transform $Mn^{3+}$ into $Mn^{4+}$ in order to satisfy the electrical neutrality. The electrical resistivity was reduced by the transformation, and the grained particles which had the insufficient Ni content are not preferred as an NTC thermistor because the electrical resistivity increases.

(4) Measurement of NTC Characteristic Constant B

The NTC characteristic constant B of an NTC thermistor thick film deposited by a method of the present invention is calculated by the following Formula 1.

$$B_{25/85} = \frac{\ln(R_{25}/R_{85})}{(1/T_{25}) - (1/T_{85})} \quad \text{[Formula 1]}$$

(In the Formula 1, $R_{25}$ and $R_{85}$ are electrical resistivity values measured at 25° C. and 85° C., respectively, and $T_{25}$ and $T_{85}$ mean temperatures at 25° C. and 85° C.)

Figure 7:
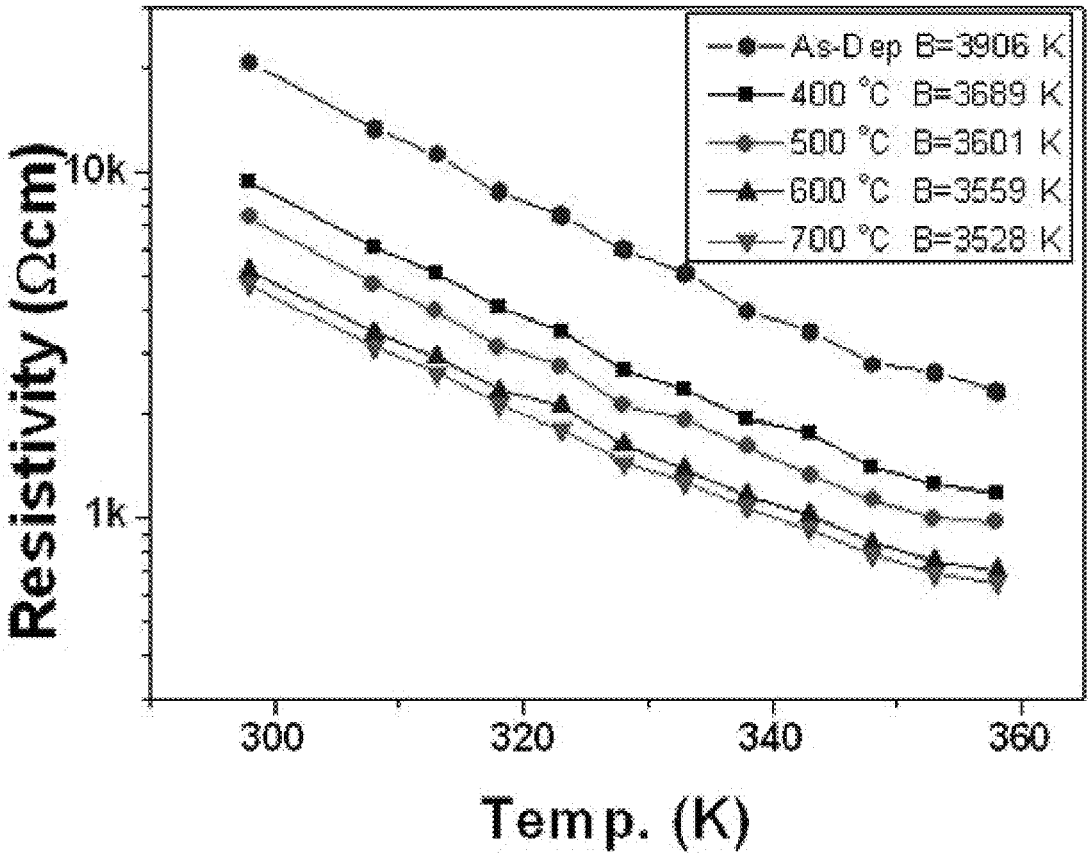
FIG. 7 is a graph illustrating the change in electrical resistivity of an NTC thermistor thick film prepared according to one embodiment of the present invention with the temperature.

The electrical resistivity changes of an NTC thermistor thick film as deposited and the thick films which had been subjected to a heat treatment at 400° C., 500° C., 600° C., and 700° C., respectively, are illustrated in FIG. 7 and Table 1.

As illustrated in FIG. 7, it was confirmed that the resistivity changes of all the samples were linearly proportional to changes in temperature.

Figure 8:
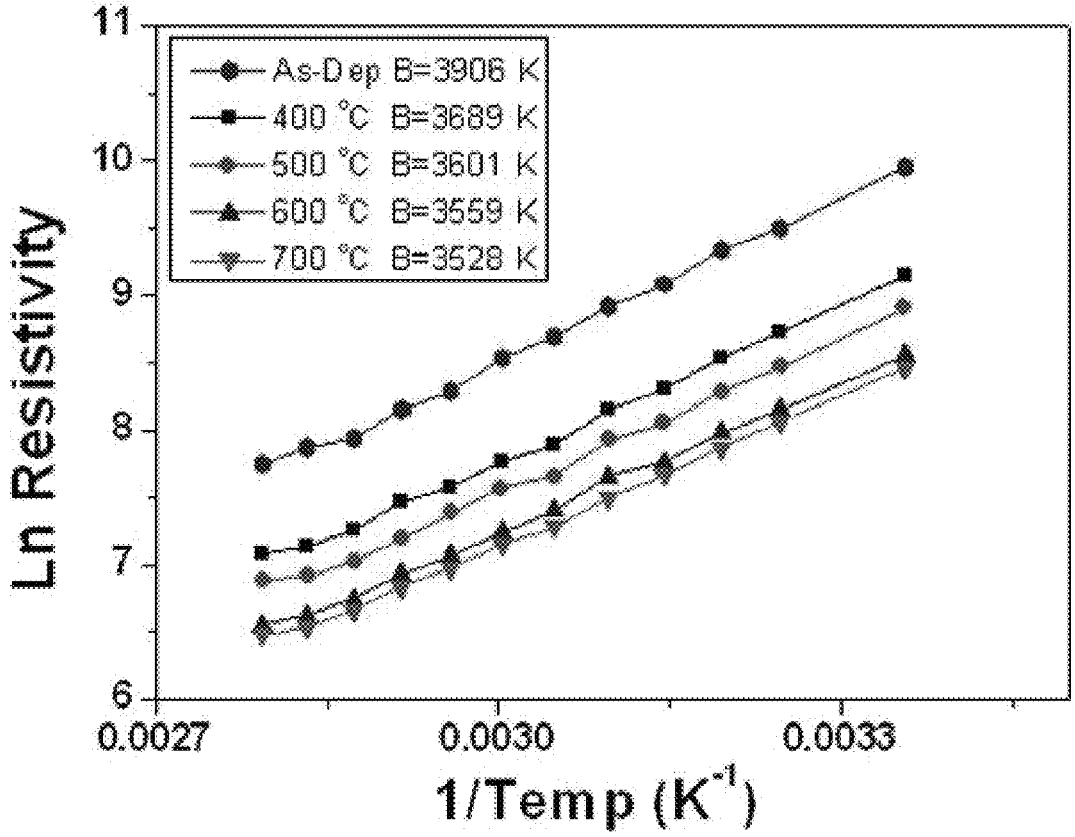
FIG. 8 is a graph illustrating logarithmic values of resistivity vs. inverse values of temperature in an NTC thermistor thick film prepared according to one embodiment of the present invention.

FIG. 8 is a graph illustrating logarithmic values of resistivity vs. inverse values of temperature, and it was confirmed that logarithmic values of resistivity of all the samples linearly decrease as the temperature increases.

The activation energy ΔE may be also calculated by the following Formula 2.

$$B = \frac{\Delta E}{k} \quad \text{[Formula 2]}$$

(In the Formula 2, ΔE and k mean the activation energy and the Boltzmann constant, respectively.)

TABLE 1

| Sample | R(MΩ) (298 K) | ρ(kΩcm) (298 K) | B(K) | ΔE(meV) |
|---|---|---|---|---|
| NTC thermistor thick film as deposited | 41.957 | 20.978 | 3906 | 337 |
| Heat treatment at 400° C. | 18.850 | 9.425 | 3689 | 318 |
| Heat treatment at 500° C. | 14.813 | 7.406 | 3601 | 310 |
| Heat treatment at 600° C. | 10.407 | 5.203 | 3559 | 307 |
| Heat treatment at 700° C. | 9.483 | 4.741 | 3528 | 304 |

As illustrated in Table 1, an NTC thermistor thick film as deposited had a high thermistor constant of 3900 K or higher. As the temperature of heat treatment increased, the resistivity at room temperature decreased while all the thermistor constants (B constants) were maintained at 3500 K or more.

The electrical resistivity at room temperature of the thick film was 20.978 kΩcm while the electrical resistivity decreased as the temperature of heat treatment increased, leading to 4.741 kΩcm at 700° C. The activation energy also gradually decreased as the temperature of heat treatment increased, and the activation energy values of samples heat treated at 400° C., 500° C., 600° C., and 700° C. after deposition were measured at 337 meV, 318 meV, 310 meV, 307 meV, and 304 meV, respectively. It is thought that the decreases in B constant and activation energy depending on the temperature of heat treatment are related to the growth of grain particles according to a heat treatment. It is thought that as the surface areas of the grain particles decreased, the electrical resistivity was decreased by the grain interfaces and the activation energy was also decreased. Although the B constant decreased according to the temperature of heat treatment, all the thick film samples prepared by a room temperature powder spray in vacuum (AD) had values of 3500 K or more, which are much more than those of the NTC thick films prepared by conventional screen printing methods in the NTC material of the same composition. The fact that the electrical resistivity at room temperature changes according to the temperature of heat treatment means that the electrical resistivity at room temperature may be controlled according to applications using the same material.

EXPERIMENTAL EXAMPLE 1

Average Particle Diameters of Ceramic Powders

In order to observe the optimal average particle diameter ($d_{50}$) of an $NiMn_2O_4$ powder to be deposited by a process of spraying the powder at room temperature, the density distributions according to the average particle diameters are measured and illustrated in FIG. 9.

As illustrated in FIG. 9, it was confirmed that the optimal average diameter ($d_{50}$) of the $NiMn_2O_4$ powder was about 1.4 μm.

EXPERIMENTAL EXAMPLE 2

NTC Characteristic Changes According to Changes in Thickness

In order to observe the NTC characteristic changes according to changes in thickness of an NTC thermistor thick film prepared by a room temperature powder spray in vacuum (AD), experiments were performed in the following way.

(1) Measurement by Scanning Electron Microscopy

An NTC thermistor thick film prepared by a room temperature powder spray in vacuum (AD) was deposited by changing its thickness into about 3 μm to about 50 μm, and then the cross-section of each sample was measured by scanning electron microscopy. The measurement results were illustrated in FIG. 10.

Figure 10:
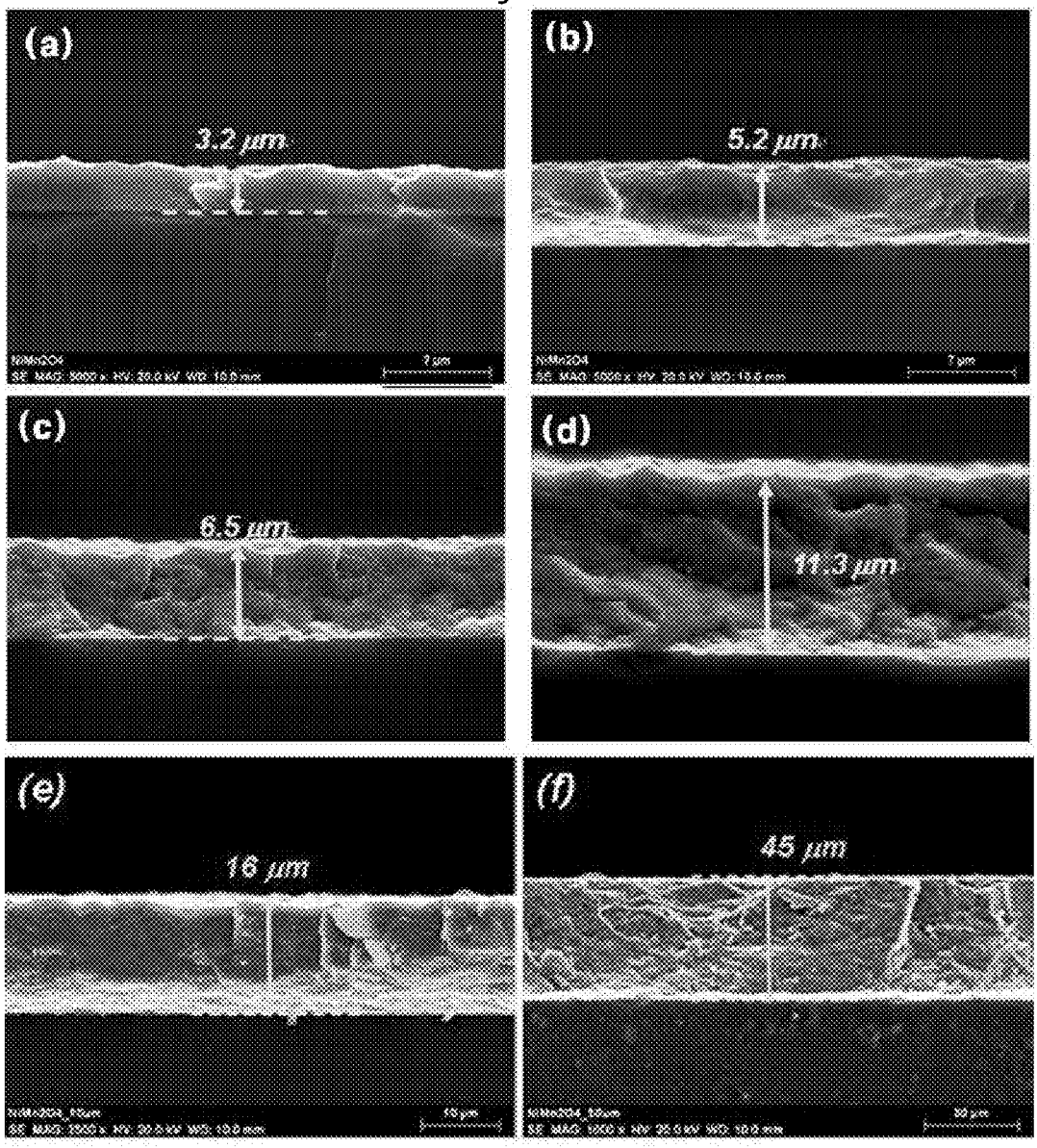
FIG. 10 is a set of SEM photos illustrating cross-sectional areas of NTC thermistor thick films in a thickness order according to one embodiment of the present invention.

As illustrated in FIG. 10, it may be understood that a highly dense NTC thermistor thick film may be prepared without any generation of pores, cracks, and laminations even though its thickness increases.

(2) Measurement of Electrical Resistances According to Changes in Temperature

An NTC thermistor thick film prepared by a room temperature powder spray in vacuum (AD) was deposited by changing its thickness into about 3 μm to about 50 μm to prepare samples. The samples were subjected to a heat treatment at 600° C. for 1 hour. The electrical resistance values of all the samples were measured and illustrated in FIG. 11.

Figure 11:
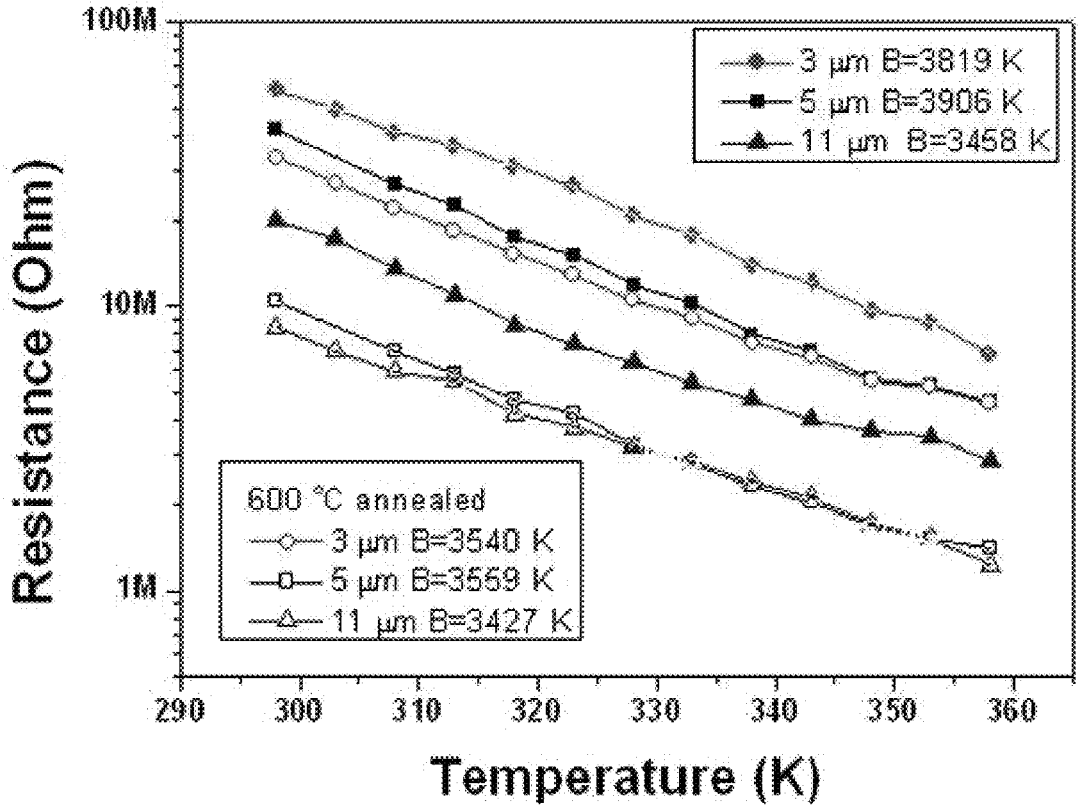
FIG. 11 is a graph illustrating resistance values measured as the temperature changes in each thickness of an NTC thermistor thick film according to one embodiment of the present invention.

As illustrated in FIG. 11, the electrical resistance values of all the samples linearly decreased according to increase in temperature and B constant was also maintained at 3400 K or more. As the thickness increased, the electrical resistance decreased. It may be understood that this was due to a decrease in electrical resistance as the cross-section increased and did not have much effects on the NTC characteristics.

Therefore, NTC thermistors with various thicknesses may be prepared by a room temperature powder spray in vacuum (AD) according to the present invention and the electrical resistance may be controlled according to its thickness.

EXPERIMENTAL EXAMPLE 3

Deposition Characteristics According to Changes in Composition

In order to observe the changes in deposition characteristics of an NTC thermistor thick film prepared by a room temperature powder spray in vacuum (AD) of the present invention according to changes in powder composition, experiments were performed in the following way.

Except that the Ni content in the basic composition of $NiMn_2O_4$ was infinitesimally changed into 0.95 or 1.05, an NTC thermistor thick film was prepared in the same manner as in Embodiment 1, and the measurement of the microstructures and the elemental analysis of EDX were performed. The results are illustrated in FIG. 12.

Figure 12:
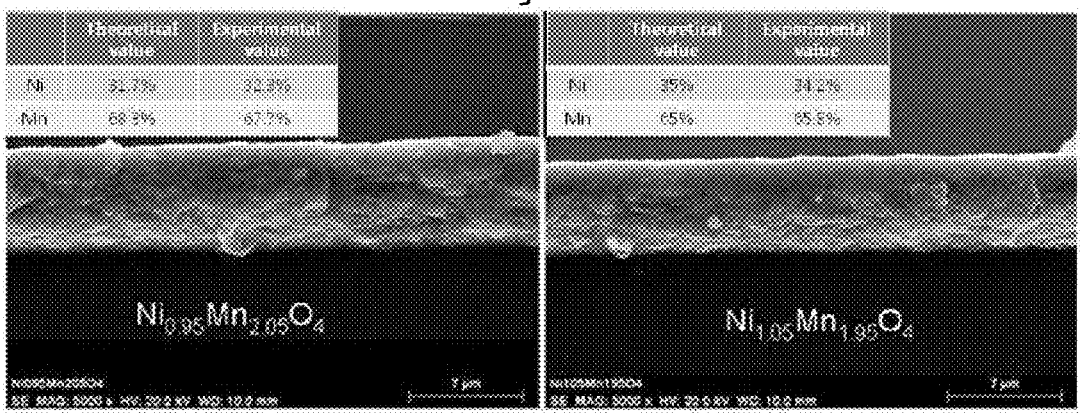
FIG. 12 is a set of SEM photos of an NTC thermistor thick film according to the composition of a powder material to prepare an NTC thermistor thick film according to one embodiment of the present invention.

In FIG. 12, the theoretical values in the photos are content ratios of Ni and Mn elements while the experimental values are measured content values of Ni and Mn elements in an NTC thick film prepared.

As illustrated in FIG. 12, the contents of Ni and Mn elements are different within 1% or less between the theoretical value and the experimental value. Considering the analysis limitations of EDX, it may be concluded that the theoretical value was identical to the experimental value. That is, the composition of an NTC thick film may be changed by changing the composition of powder.

Although the composition of powder changed, it may be confirmed that much change was not seen in the microstructure of a thick film.

It is impossible for an NTC material with complex compositions to be deposited by conventional thin film processes. Although it is also impossible to regulate the content finely, a preparation method according to the present invention is advantageous in that the composition of a powder material is practiced on the NTC thick film as it is.

EXPERIMENTAL EXAMPLE 4

Deposition Characteristics According to Co Doping

In order to observe the changes in deposition characteristics of an $NiMn_2O_4$-based NTC thermistor thick film prepared by a room temperature powder spray in vacuum (AD) of the present invention according to a Co doping, experiments were performed in the following way.

Figure 13:
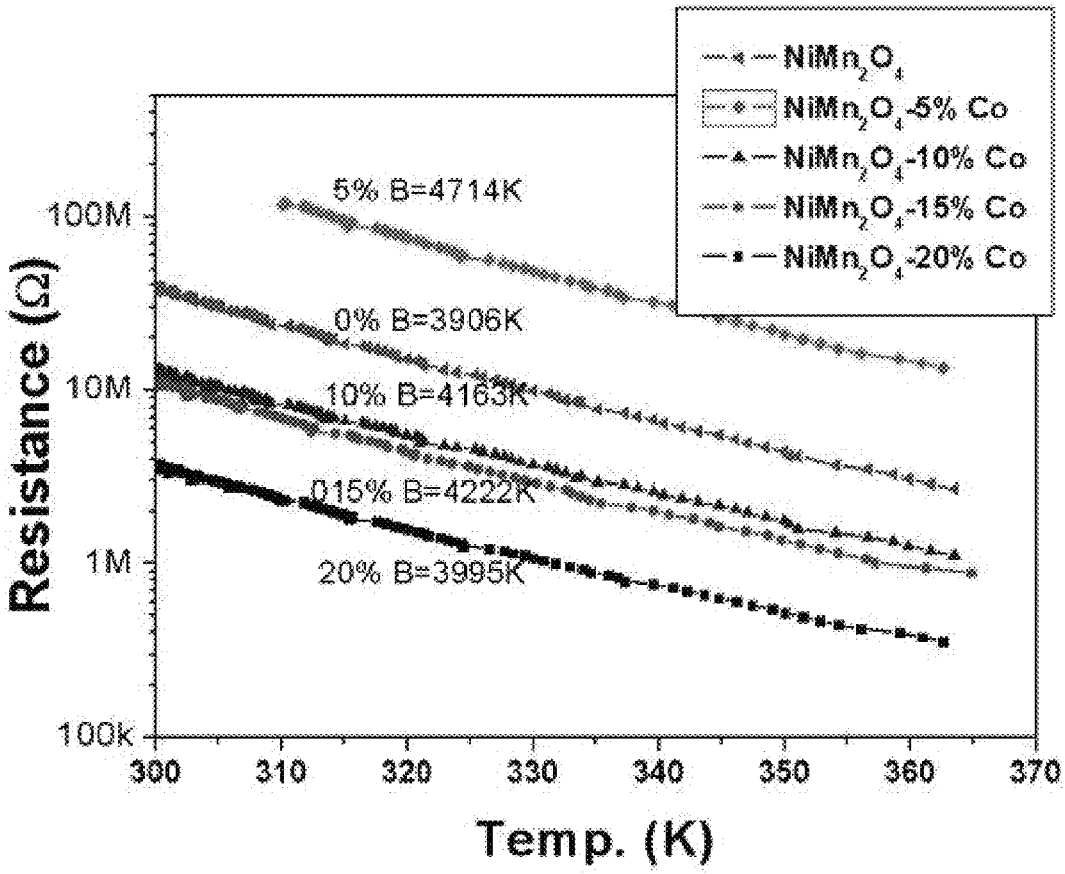
FIG. 13 is a graph illustrating electrical resistances measured according to changes in temperature for each Co doping content of an NTC thermistor thick film doped with a small amount of Co according to one embodiment of the present invention.
Figure 14:
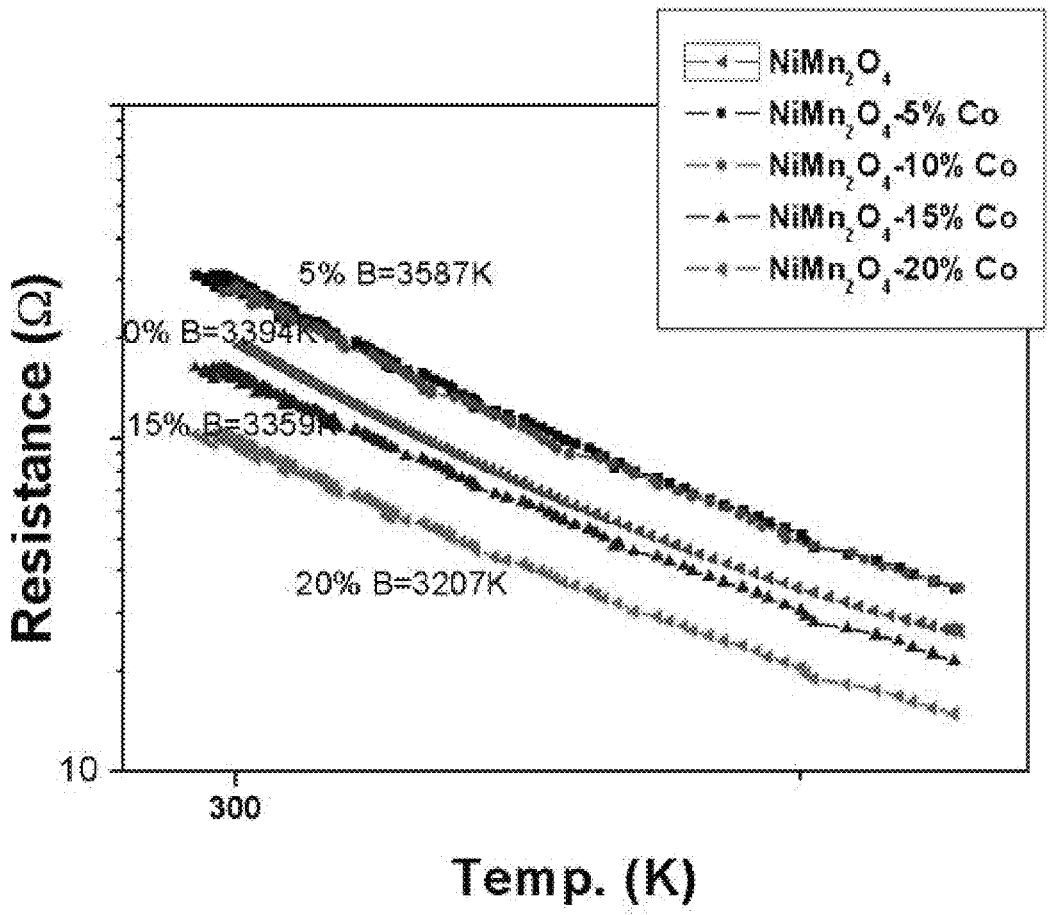
FIG. 14 is a graph illustrating electrical resistances measured according to changes in temperature for each Co doping content of an NTC thermistor thick film doped with a small amount of Co according to one embodiment of the present invention.

Except that the Co content in the basic composition of the $NiMn_2O_4$ was increased by 0 mol % or about 20 mol %, an NTC thermistor thick film was prepared in the same manner as in Embodiment 1 and changes in electrical resistance were measured according to changes in temperature. The results are shown in FIG. 13. Furthermore, changes in electrical resistance of a sintered ceramic body prepared by using the same powder were measured according to changes in temperature, and the results are shown in FIG. 14 for comparison with FIG. 13. It may be confirmed that the resistance characteristics according to temperature were changed as Co was doped, and the B constant in an NTC thermistor thick film doped with Co at about 5 mol % was 4700 K or more, a value higher than that in an NTC thermistor thick film without a doping. When compared to a sintered body in FIG. 14, the B constant of an NTC thermistor thick film with the same composition was about 1000 K or more, which is thought to be due to a highly dense microstructure.

In conventional thin film processes, it is very difficult to change characteristics of an NTC material by doping and also impossible to perform a fine content regulation. However, a preparation method of the present invention is advantageous in that the composition of a material powder is realized in an NTC thick film as it is.

EXPERIMENTAL EXAMPLE 5

Deposition Characteristics According to Co and Fe Co-Doping

In order to observe the changes in deposition characteristics of an $NiMn_2O_4$-based NTC thermistor thick film prepared by a room temperature powder spray in vacuum (AD) of the present invention according to a Co and Fe co-doping, experiments were performed in the following way.

Figure 15:
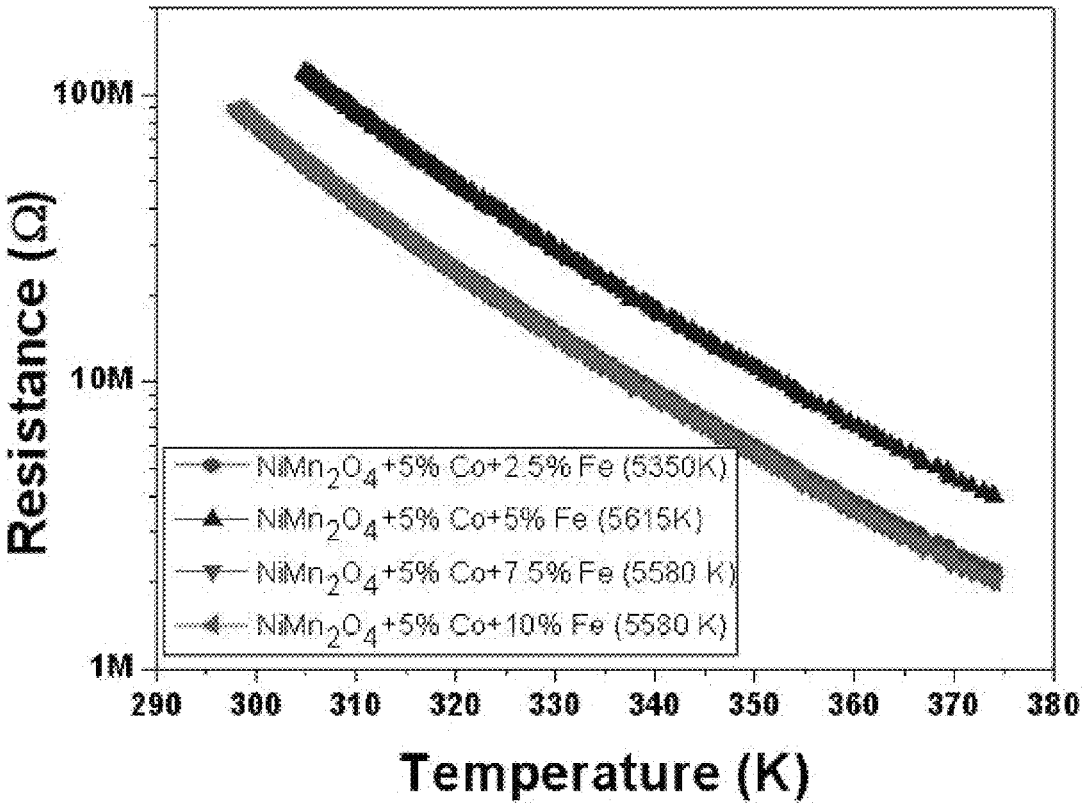
FIG. 15 is a graph illustrating electrical resistances measured according to changes in temperature for each Fe doping content of an NTC thermistor thick film doped with 5 mol % of Co according to one embodiment of the present invention.
Figure 16:
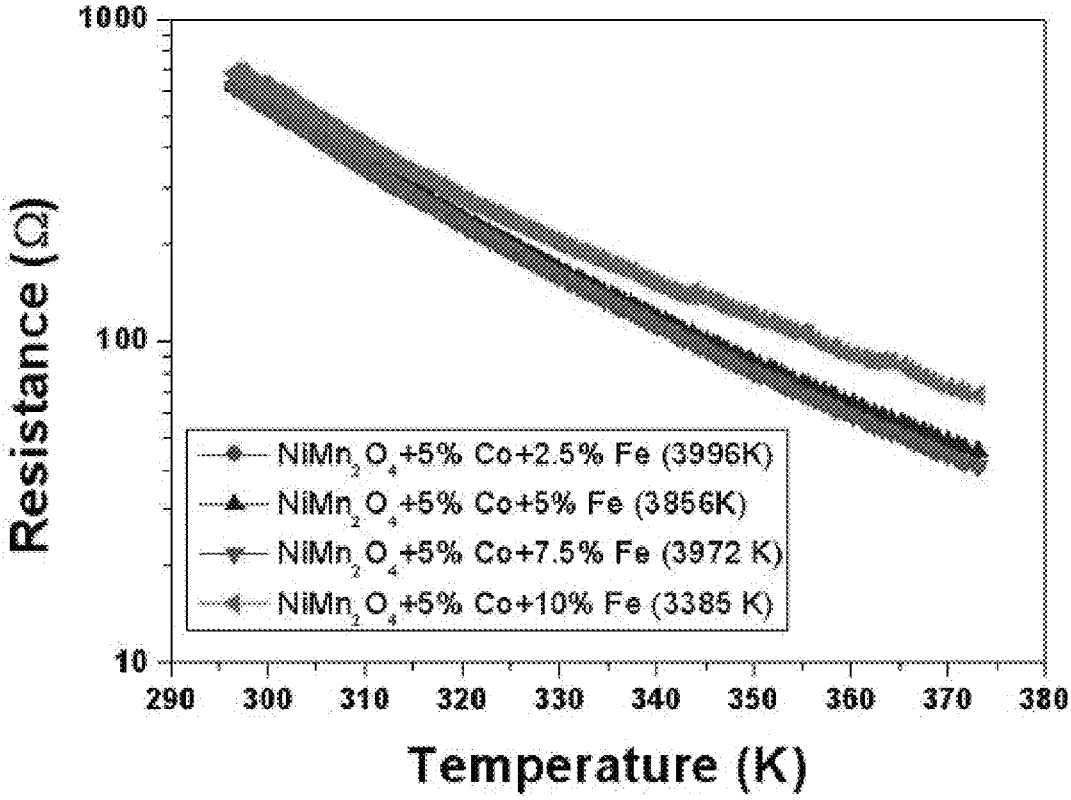
FIG. 16 is a graph illustrating electrical resistances measured according to changes in temperature for each Fe doping content of sintered NTC thermistor ceramic counterparts doped with 5 mol % of Co according to one embodiment of the present invention.

Except that the Co content in the basic composition of the $NiMn_2O_4$ was fixed to about 5 mol % and the Fe content was increased by 0 mol % or about 10 mol %, an NTC thermistor thick film was prepared in the same manner as in Embodiment 1 and changes in electrical resistance were measured according to changes in temperature. The results are shown in FIG. 15. Furthermore, changes in electrical resistance of a sintered ceramic body prepared by using the same powder were measured according to changes in temperature, and the results are shown in FIG. 16 for comparison with FIG. 15. It may be confirmed that the resistance characteristics according to temperature were changed as Fe was doped, and the B constant in an NTC thermistor thick film doped with Fe at about 5 mol % was 5500 K or more, a value higher than that in an NTC thermistor thick film without a doping. When compared to a sintered body in FIG. 16, the B constant of an NTC thermistor thick film with the same composition was about 1000 K or more, which is thought to be due to a highly dense microstructure.

In conventional thin film processes, it is very difficult to change characteristics of an NTC material by doping and also impossible to perform a fine content regulation. However, a preparation method of the present invention is advantageous in that the composition of a material powder is realized in an NTC thick film as it is.

According to the present invention, a room temperature powder spray in vacuum (AD) may be used to perform a rapid deposition of NTC thermistor thick films and prepare a highly dense ceramic thick film, the NTC characteristic constant B which would be obtained by doping may be maximized without doping, demagnetization may be obtained without any additional heat treatment, and thus limitations on substrate that the conventional art has may be completely overcome.

The scope of the present invention is not limited to the above embodiments, and various modifications are possible by those skilled in the art within the same technical scope based on the present invention.

What is claimed is:

1. An NTC thermistor thick film vacuum deposited by spraying a spinel grained ceramic powder containing Ni and Mn on one side of the surface of a substrate using a room temperature powder spray in vacuum (AD).

2. The NTC thermistor thick film as set forth in claim 1, wherein the NTC thermistor thick film has a thickness of about 0.2 μm to about 50 μm.

3. The NTC thermistor thick film as set forth in claim 1, wherein the NTC thermistor thick film has a density of 95% or more.

4. The NTC thermistor thick film as set forth in claim 1, wherein the NTC thermistor thick film has a nano-grained microstructure.

5. The NTC thermistor thick film as set forth in claim 1, wherein the NTC thermistor thick film has an NTC characteristic constant B of 3000 K or more.

6. The NTC thermistor thick film as set forth in claim 1, wherein the NTC thermistor thick film is anchored on the external surface of the substrate and then not subjected to a heat treatment process.

7. The NTC thermistor thick film as set forth in claim 1, wherein the ceramic powder is selected from the group consisting of $NiMn_2O_4$, $NiMn_2O_4$ doped with Co, $NiMn_2O_4$ doped with Fe, and $NiMn_2O_4$ doped with Cu.

8. The NTC thermistor thick film as set forth in claim 1, wherein the ceramic powder has various compositions of Ni and Mn to allow for fine regulation.

9. The NTC thermistor thick film as set forth in claim 1, wherein the ceramic powder has an average particle diameter of about 0.5 μm to about 10 μM.

10. The NTC thermistor thick film as set forth in claim 1, wherein the substrate is formed of an electric insulator.

11. A method for preparing an NTC thermistor thick film using a powder spray in vacuum, comprising:

placing a ceramic powder C into a mixing vessel to fix a substrate on a stage as a material preparation step S100;

supplying a carrier gas into the mixing vessel to mix the ceramic powder C with the carrier gas as a gas supply step S200;

feeding the carrier gas and ceramic powder C mixed in the mixing vessel to spray them on the substrate as a particle spray step S300; and transferring the stage to form the NTC thermistor thick film 220 as a thick film formation step 240.

12. The method as set forth in claim 11, wherein the ceramic powder is selected from the group consisting of $NiMn_2O_4$, $NiMn_2O_4$ doped with Co, $NiMn_2O_4$ doped with Fe, and $NiMn_2O_4$ doped with Cu.

13. The method as set forth in claim 11, wherein the ceramic powder has various compositions of Ni and Mn to allow for fine regulation.

14. The method as set forth in claim 11, wherein the substrate is formed of an electric insulator.

15. The method as set forth in claim 11, wherein the NTC thermistor thick film has a film formation rate of 0.1 μm/round or more during the NTC thermistor thick film formation step.

* * * * *